US007235761B1

(12) United States Patent
Maul et al.

(10) Patent No.: US 7,235,761 B1
(45) Date of Patent: Jun. 26, 2007

(54) HEATING APPARATUS WITH MECHANICAL ATTACHMENT

(75) Inventors: Michael D. Maul, Lexington, KY (US); James D. Gilmore, Lexington, KY (US); Gregory D. Creteau, Winchester, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 11/356,553

(22) Filed: Feb. 17, 2006

(51) Int. Cl.
*G03G 15/20* (2006.01)

(52) U.S. Cl. ..... 219/216; 219/536; 399/329

(58) Field of Classification Search ..... None
See application file for complete search history.

(56) References Cited

U.S. PATENT DOCUMENTS 5,499,087 A * 3/1996 Hiraoka et al. ..... 399/329
5,828,035 A 10/1998 Kuroda
6,023,047 A * 2/2000 Kondo et al. ..... 219/216
6,040,558 A * 3/2000 Yamazaki ..... 219/216
6,090,305 A * 7/2000 Balch et al. ..... 219/216
6,201,945 B1 * 3/2001 Schlueter et al. ..... 399/329

FOREIGN PATENT DOCUMENTS

JP 1116667 A * 1/1999
JP 2005043742 A * 2/2005

* cited by examiner

*Primary Examiner*—Joseph Pelham
(74) *Attorney, Agent, or Firm*—Stevens & Showalter, LLP

(57) ABSTRACT

In accordance with an aspect of the present invention, an image heating apparatus is provided for fusing an unfixed toner image to a substrate including a housing base for supporting a heater, and a thin film or belt extending around the housing base and heater. The heater is held to the housing base by a fastener structure that may include a pair of retainer clips having opposing ends attached to the housing base and having a central portion extending across the heater for retaining the heater in position. The clips may include outwardly extending walls for engaging edges of the belt to maintain the lateral position of the belt.

17 Claims, 5 Drawing Sheets

HEATING APPARATUS WITH MECHANICAL ATTACHMENT

BACKGROUND OF THE INVENTION

1. Field of the Invention

The present invention relates to an electrophotographic image forming apparatus, and more particularly to a heater attachment structure for use in a fusing system of such an apparatus.

2. Description of Related Art

In an electrophotographic image forming apparatus, such as a printer or copier, a latent image is formed on a light sensitive drum and developed with toner. The toner image is then transferred onto media, such as a sheet of paper, and is subsequently passed through a fuser assembly where heat and pressure are applied to melt and adhere the unfused toner to the surface of the media. There are a variety of devices to apply heat and pressure to the media such as radiant fusing, convection fusing, and contact fusing. Contact fusing is the typical approach of choice for a variety of reasons including cost, speed and reliability. Contact fusing systems themselves can be implemented in a variety of manners. For example, a roll fusing system consists of a fuser roll and a backup roll in contact with one another so as to form a nip therebetween, which is under a specified pressure. A heat source may be associated with the fuser roll, backup roll, or both rolls in order to raise the temperature of the rolls to a temperature capable of adhering unfixed toner to a medium. As the medium passes through the nip, the toner is adhered to the medium via the pressure between the rolls and the heat resident in the fusing region (nip).

As an alternative to the roll fusing system, a belt fusing system can be used. In one configuration of a belt fusing system, a heater, such as a ceramic heater may be supported on a supporting member, and a pressure roll may be pressed against the heating element with a thin film belt member therebetween. Heat from the heat source may pass through the thin film to heat and adhere unfixed toner to a medium as the medium is passed between the pressure roll and the belt.

In a known construction of a belt fusing system, a ceramic heater may be attached to a supporting member with an adhesive, such as a silicone adhesive. Assembly of the heater to the supporting member using adhesive generally requires a significant investment in processing equipment, as well as a relatively long "cycle time," such as twenty-four hours, to allow the adhesive to cure. The adhesive bond may limit thermal expansion of the heater relative to the supporting member where the heater and supporting member have different coefficients of thermal expansion, and thus may cause a structural failure of the heater due to thermally induced stresses. Also, it has been observed that many "late" to "end of life" heater assembly failures have occurred as a result of a failure of the bond formed by the adhesive between the heater and the supporting member. This failure of the adhesive bond may allow the heater to move on the supporting member in an uncontrolled manner in the process direction. With the heater no longer fixed, the thin film belt may track uncontrollably side-to-side in the nip area, which can eventually lead to a failure of the belt and require fuser replacement.

U.S. Pat. No. 5,828,035 discloses a heating apparatus in which a heater is movably supported on a support member without requiring an adhesive to attach the heater. During operation of the heating apparatus, the heater is allowed to move in the process direction within a space defined in a heater holder structure. The disclosed structure permits movement of the heater relative to the nip location, and it is believed that this may adversely affect belt tracking and may lead to additional belt wear and inconsistent print quality as compared to a heater that is precisely fixed in an immovable position.

Further, a wear condition has been observed to occur at certain contact points between the thin film belt and the heater of belt fusing systems incorporating ceramic heaters. In particular, a wear pattern on a glass layer of the ceramic heater contacting the belt has been observed to occur at a location that generally matches up with the ends or outer edges of the belt.

Accordingly, alternative designs of image heating apparatus comprising a thin film belt passing over a heater are desired.

SUMMARY OF THE INVENTION

In accordance with one aspect of the invention, an image heating apparatus is provided comprising a heater having opposing first and second sides, and a support member in engagement with the second side of the heater. A movable member extends around the support member and contacts the first side of the heater. The apparatus further includes a fastener structure extending around the heater for positioning the heater on the support member.

In accordance with another aspect of the invention, an image heating apparatus is provided comprising a ceramic heater having opposing first and second sides, and a support member in engagement with the second side of the heater. A movable member extends around the support member and contacts the first side of the heater. The apparatus further includes a fastener structure comprising first and second fastener elements. The fastener elements are attached to the support member and extend around the heater for positioning the heater on the support member.

DETAILED DESCRIPTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
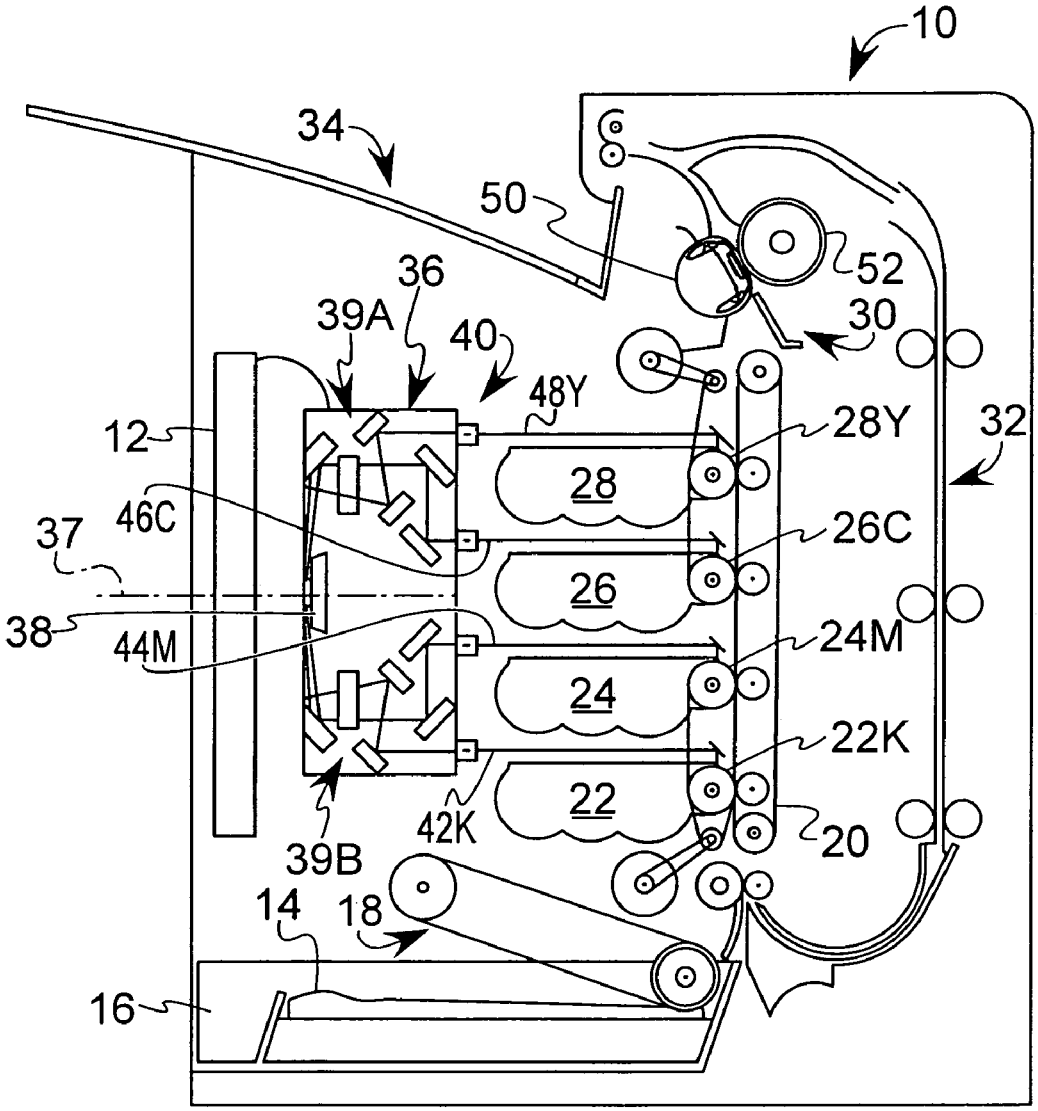
FIG. 1 is a schematic illustration of an electrophotographic printer in which a fuser assembly of the present invention may be incorporated.

FIG. 1 depicts a representative electrophotographic image forming apparatus, such as a color laser printer, which is indicated generally by the numeral 10. An image to be printed is electronically transmitted to a print engine controller or processor 12 by an external device (not shown) or may comprise an image stored in a memory of the processor 12. The processor 12 includes system memory, one or more processors, and other logic necessary to control the functions of electrophotographic imaging.

In performing a printing operation, the processor 12 initiates an imaging operation where a top substrate 14 of a stack of media is picked up from a media tray 16 by a pick mechanism 18 and is delivered to a media transport belt 20. The media transport belt 20 carries the substrate 14 past each of four image forming stations 22, 24, 26, 28, which apply toner to the substrate 14. The image forming station 22 includes a photoconductive drum 22K that delivers black toner to the substrate 14 in a pattern corresponding to a black image plane of the image being printed. The image forming station 24 includes a photoconductive drum 24M that delivers magenta toner to the substrate 14 in a pattern corresponding to the magenta image plane of the image being printed. The image forming station 26 includes a photoconductive drum 26C that delivers cyan toner to the substrate 14 in a pattern corresponding to the cyan image plane of the image being printed. The image forming station 28 includes a photoconductive drum 28Y that delivers yellow toner to the substrate 14 in a pattern corresponding to the yellow image plane of the image being printed. The processor 12 regulates the speed of the media transport belt 20, media pick timing and the timing of the image forming stations 22, 24, 26, 28 to effect proper registration and alignment of the different image planes to the substrate 14.

The media transport belt 20 then carries the substrate 14 with the unfused toner image superposed thereon to an image heating apparatus or fuser assembly 30, which applies heat and pressure to the substrate 14 so as to promote adhesion of the toner thereto. Upon exiting the fuser assembly 30, the substrate 14 is either fed into a duplexing path 32 for performing a duplex printing operation on a second surface of the substrate 14, or the substrate 14 is conveyed from the apparatus 10 to an output tray 34.

To effect the imaging operation, the processor 12 manipulates and converts data defining each of the KMCY image planes into separate corresponding laser pulse video signals, and the video signals are then communicated to a printhead 36. The printhead 36 may include four laser light sources (not shown) and a single polygonal mirror 38 supported for rotation about a rotational axis 37, and post-scan optical systems 39A and 39B receiving the light beams emitted from the laser light sources. Each laser of the laser light sources emits a respective laser beam 42K, 44M, 46C, 48Y, each of which is reflected off the rotating polygonal mirror 38 and is directed towards a corresponding one of the photoconductive drums 22K, 24M, 26C and 28Y by select lenses and mirrors in the post-scan optical systems 39A, 39B.

Figure 2:
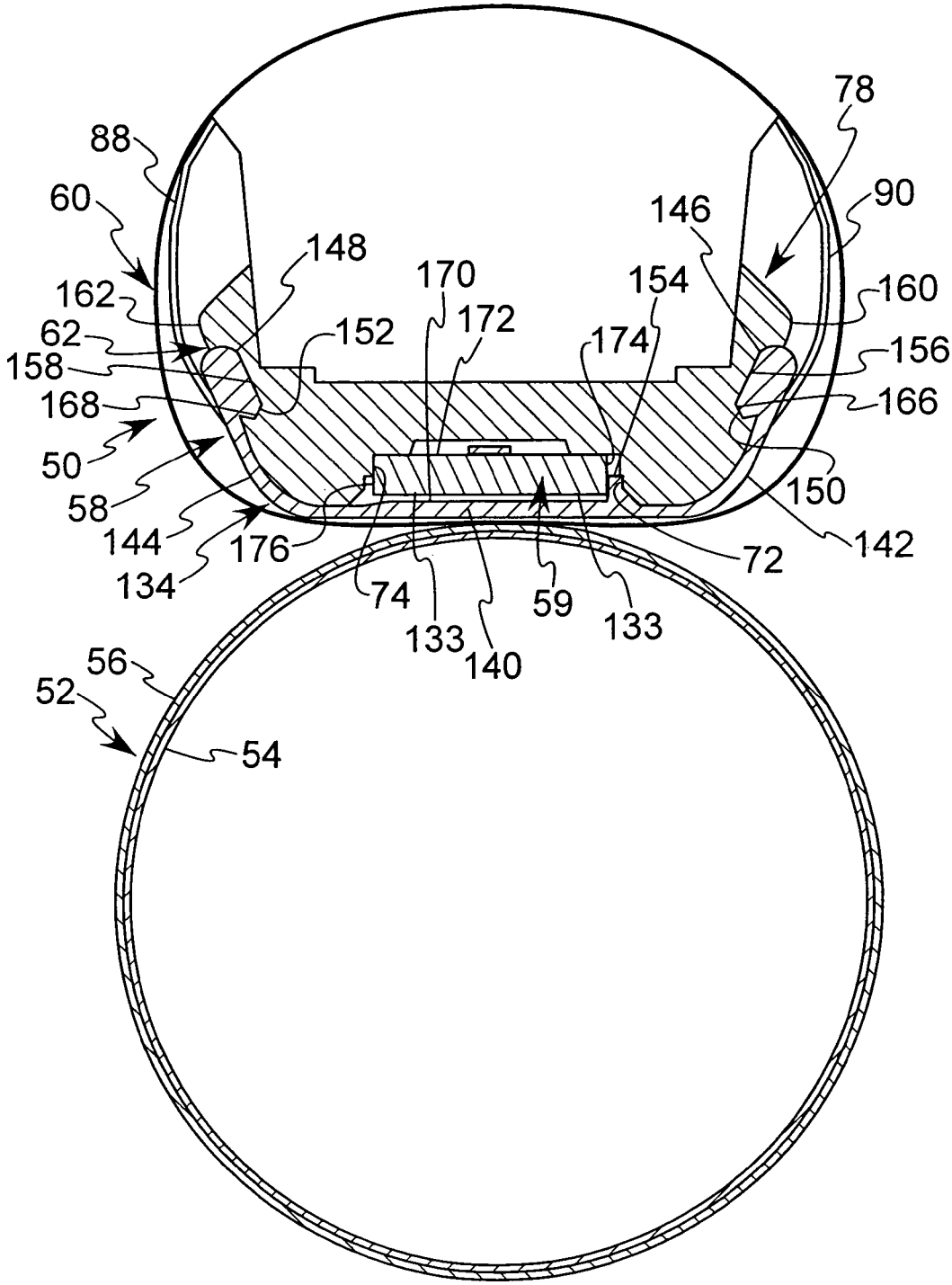
FIG. 2 is a side cross-sectional view of the fuser assembly illustrated in FIG. 1.

Referring to FIG. 2, the fuser assembly 30 in the illustrated embodiment includes a heater assembly 50 and a pressure roller 52 cooperating with the heater assembly 50 to define a nip for conveying substrates 14 therebetween. The pressure roller 52 may comprise a hollow core 54 covered with an elastomeric layer 56, such as silicone rubber, and a fluororesin outer layer (not shown), such as may be formed, for example, by a spray coated PFA (polyperfluoroalkoxy-tetrafluoroethylene) layer or a PTFE (polytetrafluoroethylene) sleeve. The pressure roller 52 has an outer diameter of about 30 mm. The pressure roller 52 may be driven by a fuser drive train (not shown) to convey substrates 14 through the fuser 30.

The heater assembly 50 may comprise a housing structure 58 defining a support member, a heater 59 supported on the housing structure 58, and an endless belt 60 positioned about the housing structure 58. The belt 60 may comprise a thin film, and preferably comprises a stainless steel tube having a thickness of approximately 35-50 μm and covered with an elastomeric layer, such as a silicone rubber layer, having a thickness of approximately 250-350 μm. The elastomeric layer is formed on the outer surface of the stainless steel tube so as to contact substrates 14 passing between the heater assembly 50 and the pressure roller 52.

Figure 3:
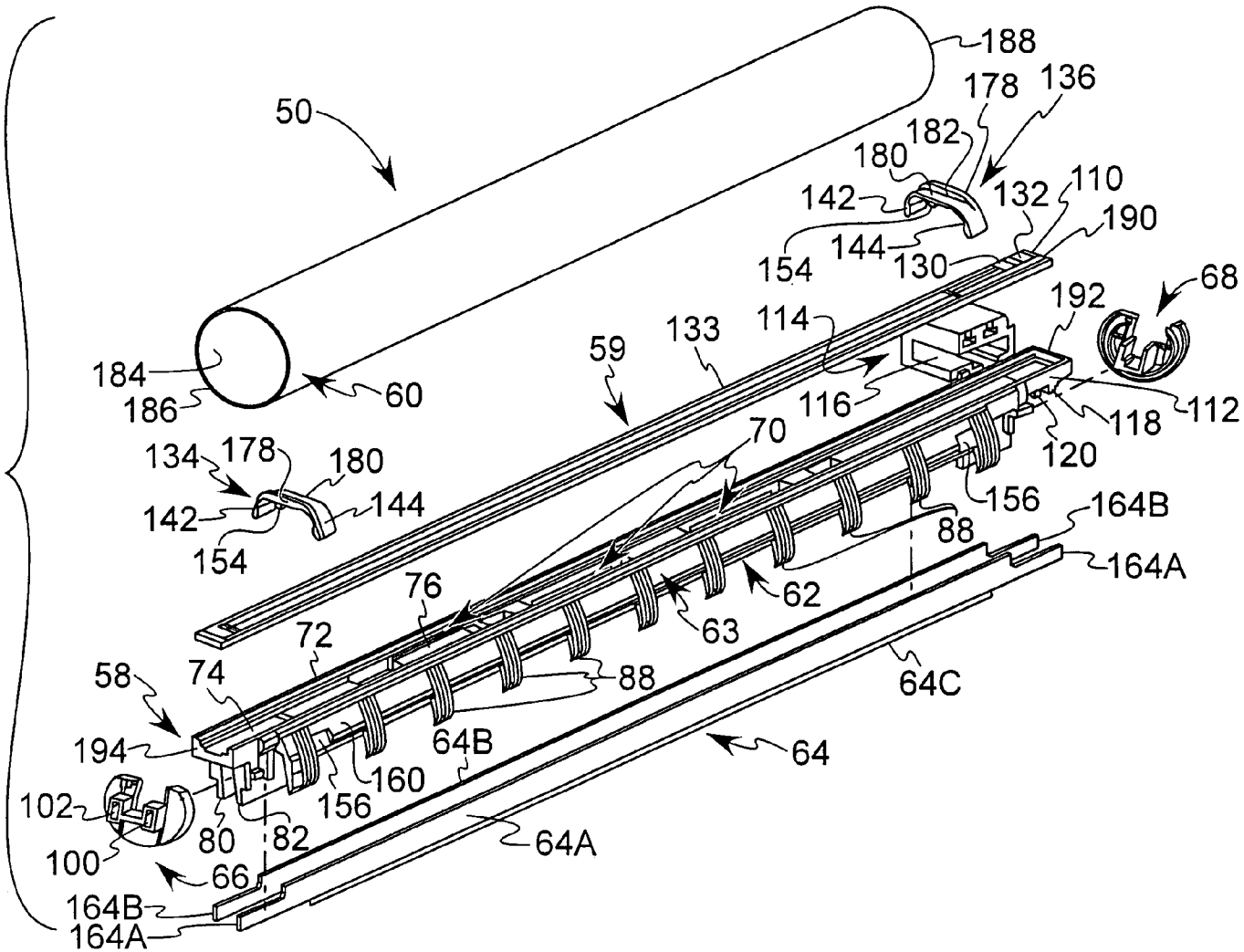
FIG. 3 is an exploded view of a heater assembly for the fuser assembly of FIG. 2.

Referring to FIG. 3, the housing structure 58 may comprise a housing base 62, a frame member 64 and first and second end caps 66, 68. The housing base 62 may be formed of a polymeric material such as a liquid crystal polymer (LCP). The housing base 62 comprises a central portion 63 defining a top or upper portion 70. The upper portion 70 includes first and second longitudinal walls 72, 74 defining a central recess 76 therebetween. The central recess 76 is formed to receive the heater 59 therein, as will be described further below.

Figure 4:
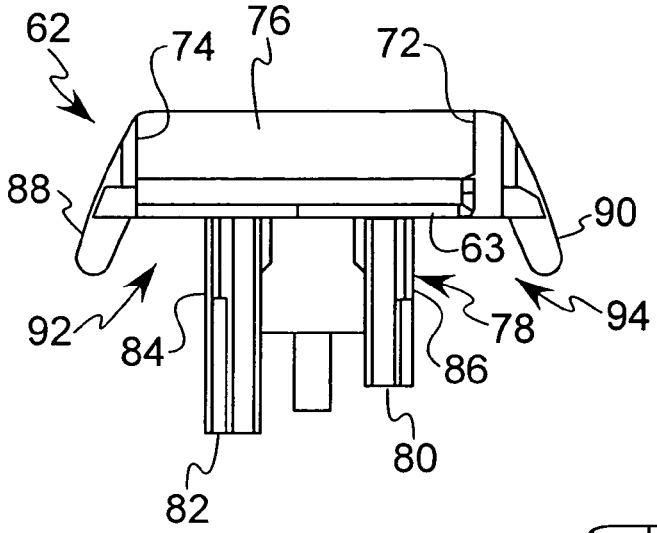
FIGS. 4 and 5 are end views of the housing base for the heater assembly.
Figure 5:
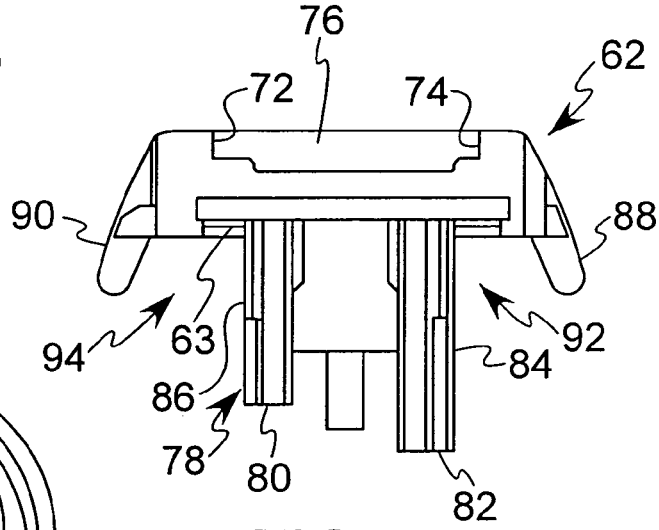

Referring additionally to FIGS. 4 and 5, a lower portion 78 of the housing base 62 includes inner walls 80, 82 extending from the central portion 63 that comprise respective engagement wall surfaces 84, 86. In addition, a plurality of curved wing portions 88, 90 extend from either side of the central portion 63 and are located outwardly from the wall surfaces 84, 86.

Referring to FIG. 3, the heater frame 64 is formed from a metal, such as steel, and comprises opposing leg parts 64A and 64B, and a base part 64C joining lower edges of the leg parts 64A, 64B so as to define a generally U-shaped member. The housing base 62 defines a space 92 between the wall surface 84 and the wing portion 88, and defines a space 94 between the wall surface 86 and the wing portion 90, see FIGS. 4 and 5. The heater frame is positioned in the lower portion 78 of the housing base 62 with the leg parts 64A, 64B positioned in the spaces 92, 94, to located inner surfaces of the leg parts 64A, 64B adjacent to the engagement wall surfaces 84, 86, respectively.

Figure 6:
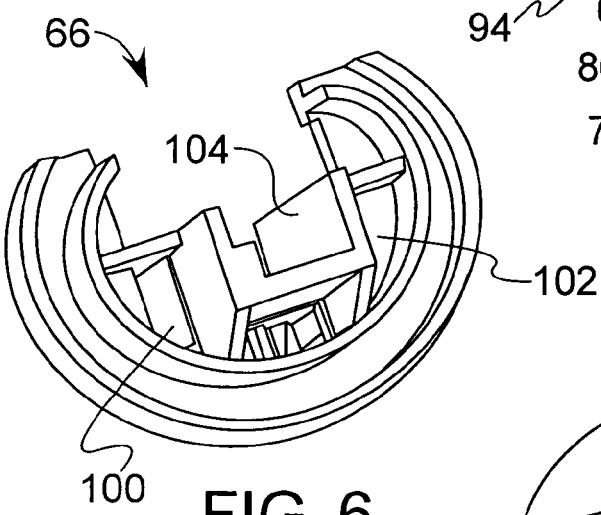
FIGS. 6 and 7 are front and rear perspective views of a typical end cap for the heater assembly.
Figure 7:
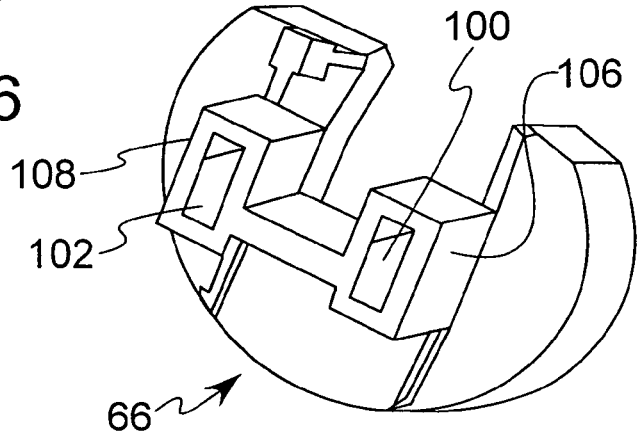

Referring to FIGS. 6 and 7, the end caps 66, 68 are described with reference to the end cap 66, wherein it should be understood that the other end cap 68 is formed with a substantially identical construction. The end cap 66 may be formed from a polymeric material, such as a liquid crystal polymer (LCP). The end cap 66 is provided with a first outer slot 100 for receiving an end 164A of the heater frame leg part 64A, and a second outer slot 102 for receiving an end 164B of the heater frame leg part 64B, see FIG. 3. A center slot 104 is provided between the outer slots 100, 102 for receiving portions of the inner walls 82, 84 extending longitudinally outwardly from the housing base 62. The end cap 66 further includes opposing outer mounting walls 106, 108 for engaging with a wall of a fuser frame (not shown). In particular, the outer mounting wall 106, 108 may slide between edges of slots in the fuser frame to position the heater assembly 50 within the fuser 30.

Figure 8:
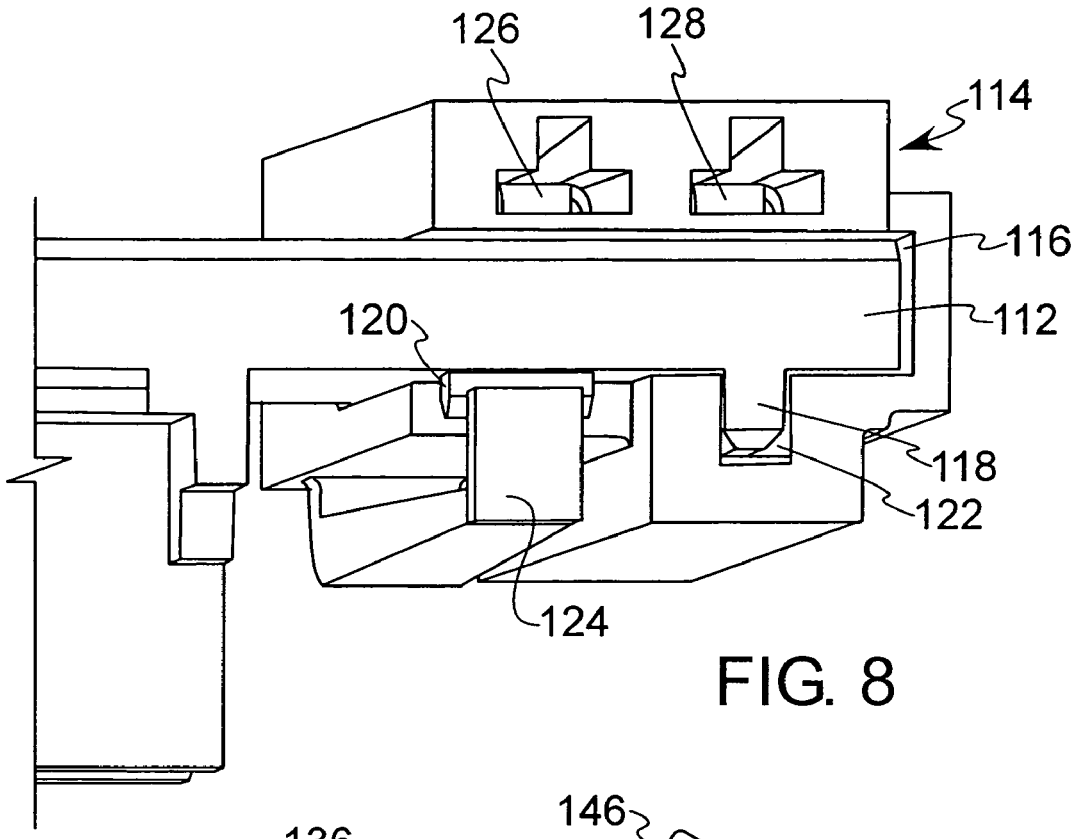
FIG. 8 is a perspective view of a power connector attached to a connector extension of the housing base.

Referring to FIG. 3, the heater 59 includes a connection end 110. The connection end 110 of the heater 59 may extend onto a connector extension 112 of the housing base 62 when the heater 59 is positioned in the recess 76. A power connector 114 is provided for engagement with the connector extension 112 such that it is located in engagement with exposed contacts 130, 132 of the heater 59. The power connector 114 is formed with a recess 116, see also FIG. 8, that receives the connector extension 112. The connector extension 112 includes a guide rib 118 extending widthwise across the connector extension 112, and a latch tab 120 located adjacent one edge of the connector extension 112. The power connector 114 includes a guide groove 122 for receiving the guide rib 118 in sliding engagement, and further includes a resilient latch member 124 for engaging the latch tab 120 to maintain the power connector 114 in position on the connector extension 112. The power connector 114 further includes contacts 126, 128 that extend toward the recess 116 to engage the exposed contacts 130, 132 on the heater 59 to thereby provide power to the heater 59.

It should be noted that the connector extension 112 and connector 114 are located longitudinally outwardly from the end cap 68 when the end cap 68 is attached to the housing base 62. Accordingly, when the heater assembly 50 is mounted within a fuser frame (not shown), the connector 114 will be located outside of the fuser frame.

The heater 59 preferably comprises a ceramic heater, and in the illustrated embodiment it comprises a ceramic heater having a heating element defined by a single trace on a first, heating surface 133 of the heater 59, facing outwardly from the housing base 62. The heating surface 133 is preferably covered by a layer of glass to provide a contact surface that protects the heater element.

Figure 9:
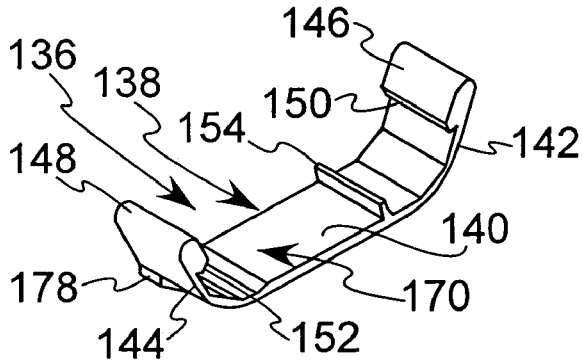
FIG. 9 is a perspective view of a retainer clip for attaching a heater to the housing base.
Figure 10:
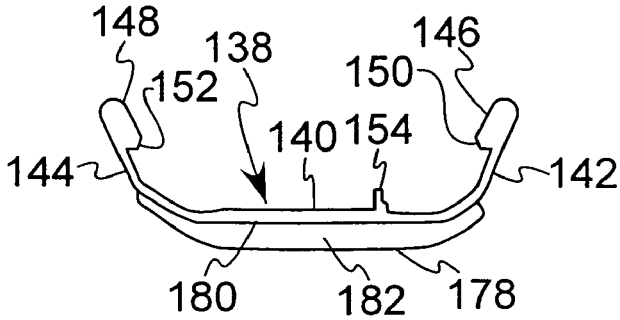
FIG. 10 is a side view of the retainer clip of FIG. 9.

Referring to FIGS. 2 and 3, the heater 59 is held in position on the housing base 62 by a fastener structure comprising first and second fastener elements or retainer clips 134, 136. FIGS. 9 and 10 illustrate the retainer clip 136 wherein it should be understood that the retainer clip 134 is formed with a substantially similar construction. Each retainer clip 134, 136 includes a clip body 138 that is preferably formed of a material that provides a coefficient of thermal expansion substantially similar to the coefficient of expansion of the housing base 62. In the described embodiment, the clip body 138 may be formed of a liquid crystal polymer (LCP).

The clip body 138 includes a central portion 140 and arm portions 142, 144 located at opposing ends of the central portion 140. Each of the arm portions 142, 144 supports a respective latch tooth portion 146, 148, each latch tooth portion 146, 148 including a respective generally convex engagement face 150, 152 facing inwardly toward the central portion 140. A biasing element comprising a laterally extending rib 154 extends from the central portion 140 and is located proximal to the arm portion 142.

As seen in FIG. 2, the retainer clips 134, 136 are positioned on the housing base 62 with the latch tooth portions 146, 148 located within respective recesses 156, 158 formed on outer sides 160, 162 of the housing base 62. The engagement faces 150, 152 seat within respective generally concave areas 166, 168 of the recesses 156, 158 to latch the retainer clips 134, 136 onto the housing base 62 with an inner face 170 of the central portion 140 extending across the heating surface 133 of the heater 59 and biasing a second surface 172 of the heater 59 toward engagement within the recess 76 (FIG. 3). In addition, the rib 154 is located between a leading or upstream edge 174 of the heater 59, as viewed in the process direction, and the first longitudinal wall 72 to bias a trailing or downstream edge 176 of the heater 59 toward the second longitudinal wall 74.

The retainer clips 134, 136 wrap around a portion of the housing base 62 to provide a biasing force toward the housing base 62 to prevent the heater 59 from lifting from the recess 76, without requiring an adhesive attachment of the heater 59 to the housing base 62. In addition, the biasing elements defined by the ribs 154 bias the heater 59 against a longitudinal wall, i.e., against the second longitudinal wall 74, to prevent or limit movement of the heater 59 in the process direction, and substantially positively defines the location of the heater 59 in the process direction.

It should be understood that the construction of the retainer clips 134, 136 is not limited to the particular embodiment illustrated herein, and they may be provided with an additional rib, similar to the rib 154, to engage the downstream edge 176 of the heater 59 for further locating the heater 59 relative to the housing base 62. Alternatively, the rib 154 may be located on the central portion 140, proximal to the arm portion 144, to engage the downstream edge 176 instead of the upstream edge 174 of the heater 59, to bias the heater 59 toward engagement with the first longitudinal wall 72.

The retainer clips 134, 136 may additionally be formed with a guide wall 178 extending from an outer surface 180 of the central portion 140, see FIGS. 3, 9 and 10. The guide wall 178 defines a guide surface 182 oriented generally perpendicular to the heating surface 133, where the guide surfaces 182 of the pair of retainer clips 134, 136 face inwardly toward each other to form lateral guides to engage the edges 186, 188 (FIG. 3) of the belt 60 and guide or limit lateral movement of the belt 60.

The heater assembly 50 is assembled by mounting the heater 59 in the recess 76 of the housing base 62 with an end edge 190 of the heater 59 against an end wall 192 of the recess 76, attaching at least one of the retainer clips 134, 136, such as retainer clip 136, to the housing base 62, positioning the heater frame 64 in engagement with the lower portion 78 of the housing base 62, slipping the belt 60 over the combined housing base 62, heater 59 and heater frame 64, and attaching the remaining clip 134 to the housing base 62. The ends caps 66, 68 may then be attached to the ends of the base housing 62. When the heater assembly 50 is assembled into the fuser frame (not shown), the slots in the fuser frame receive the outer mounting walls 106, 108 of the end caps 66, 68 to maintain the end caps 66, 68, housing base 62 and heater frame 64 assembled together. It may be noted that the end 194 (FIG. 3) of the recess 76 opposite the end wall 192 is not provided with an end wall in order to allow room for lengthwise thermal expansion of the heater 59 at the end 194.

The retainer clips 134, 136 are spaced from each other along the length of the housing base 62 a distance that positions the outer surfaces 180 of the retainer clips 134, 136 in engagement with an inner surface 184 (FIG. 3) of the belt 60, adjacent the outer edges 186, 188 of the belt 60. The surfaces 180 extend substantially parallel to the heating surface 133 of the heater 59 and act as wear surfaces preventing or reducing the wear that may occur on the glass layer of the heating surface 133 in the area of the outer edges 186, 188 of the belt 60. Further, movement of the belt across the heater 59 may be facilitated by application of a grease to the heater 59 or to the inner surface 184 of the belt 60 during assembly of the heater assembly 50 to lubricate the contact area between the belt 59 and the heater 60. An example of a commercially available grease that may be applied is DEMNUM L200 grease, a product of Daikin Industries, Ltd., of Japan.

The pressure roller 52 rotatably engages the belt 60, and friction between the pressure roller 52 and the belt 60, or between a medium 14 passing through the fuser 30 between the pressure roller 52 and the belt 60, drives the belt 60 such that it rotates with the pressure roller 52. The belt is guided in a generally circular path around the wings 88, 90 of the housing base 62 and past the heater 59.

The described construction for retaining the heater 59 to the housing base 62 acts to retain the heater 59 in a predetermined position on the housing base 62 without requiring use of an adhesive. In addition to locating the heater 59 in position, the fastener structure described herein permits differential thermal movement of the heater 59 relative to heater base 62, to alleviate thermal stresses that may otherwise occur if a more rigid connection is provided for holding the heater 59 in position. Also, the retainer clips 134, 136 provide a fastener structure that may be efficiently applied during assembly of the heater assembly 50, thus substantially reducing the assembly time that may be required when adhesives are applied.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An image heating apparatus comprising:

a heater having opposing first and second sides;

a support member in engagement with said second side of said heater;

a movable member comprising an endless film member extending around said support member and contacting said first side of said heater;

a fastener structure extending around said heater for positioning said heater on said support member; and wherein said fastener structure comprises guide surfaces extending generally perpendicular to said first side of said heater for engaging edges of said film member and said fastener structure engaging an inner surface of said edges of said film member.

2. The apparatus of claim 1, wherein said heater comprises an elongated member having opposing longitudinal ends, and said fastener structure comprises a fastener element located adjacent each longitudinal end of said heater.

3. The apparatus of claim 2, further including a connector attached to an end of said heater for providing power to said heater.

4. The apparatus of claim 1, wherein said fastener structure defines a wear surface between said film member and said heater at said edges of said film member.

5. The apparatus of claim 4, wherein said fastener structure includes surfaces generally parallel to said first side of said heater for engaging an inner surface of said film member to prevent a portion of said inner surface from engaging said heater.

6. The apparatus of claim 5, wherein said heater comprises a ceramic heater and said first side of said heater comprises a glass surface contacting said film member.

7. The apparatus of claim 1, wherein said fastener structure biases said heater in a process direction relative to said support member.

8. The apparatus of claim 7, wherein said fastener structure includes biasing elements extending into engagement with a leading edge of said heater for biasing said heater relative to said support member in a direction parallel to the process direction.

9. The apparatus of claim 1, wherein said movable member comprises a stainless steel tube.

10. The apparatus of claim 1, further comprising a pressure roller for forming a nip with said heater with said movable member interposed therebetween.

11. An image heating apparatus comprising:

a ceramic heater having opposing first and second sides;

a support member in engagement with said second side of said heater;

a movable member extending around said support member and contacting said first side of said heater;

a fastener structure comprising first and second fastener elements attached to said support member and extending around said heater for positioning said heater on said support member; and wherein said first and second fastener elements comprise elongated members including opposing ends attached to said support member adjacent leading and trailing edges of said heater.

12. The apparatus of claim 11, wherein said heater comprises an elongated member having opposing longitudinal ends, and one of said fastener elements is located adjacent each longitudinal end of said heater.

13. The apparatus of claim 11, wherein said heater is attached to said support member without an adhesive.

14. The apparatus of claim 11, wherein said movable member comprises a stainless steel tube, and further comprising a pressure roller for forming a nip with said heater with said movable member interposed therebetween.

15. An image heating apparatus comprising:

a ceramic heater having opposing first and second sides;

a support member in engagement with said second side of said heater;

a movable member extending around said support member and contacting said first side of said heater;

a fastener structure comprising first and second fastener elements attached to said support member and extending around said heater for positioning said heater on said support member; and wherein said movable member comprises an endless film member surrounding said support member and said fastener elements engage an inner surface of said film member to prevent a portion of said inner surface from engaging said heater.

16. The apparatus of claim 15, wherein said fastener elements further comprise guide surfaces extending generally perpendicular to said first side of said heater for engaging edges of said film member.

17. An image heating apparatus comprising:

a ceramic heater having opposing first and second sides;

a support member in engagement with said second side of said heater;

a movable member extending around said support member and contacting said first side of said heater;

a fastener structure comprising first and second fastener elements attached to said support member and extending around said heater for positioning said heater on said support member; and wherein said fastener elements include biasing elements extending into engagement with a leading edge of said heater for biasing said heater relative to said support member in a direction parallel to the process direction.

* * * * *